US006082883A

United States Patent [19]

Tatsumi et al.

[11] Patent Number: 6,082,883

[45] Date of Patent: Jul. 4, 2000

[54] HEAD LAMP DEVICE

[75] Inventors: Yoichi Tatsumi; Masaaki Miyabe, both of Tochigi-ken, Japan

[73] Assignee: Stanley Electric Co., Ltd., Tokyo, Japan

[21] Appl. No.: 09/111,669

[22] Filed: Jul. 8, 1998

[30] Foreign Application Priority Data

Jul. 25, 1997 [JP] Japan ..... 9-200270

[51] Int. Cl.[7] ..... H01R 33/00; F21W 101/10; F21V 19/00

[52] U.S. Cl. ..... 362/548; 362/226; 362/519

[58] Field of Search ..... 362/226, 519, 362/548

[56] References Cited

U.S. PATENT DOCUMENTS 4,819,133 4/1989 Kochi, et al. ..... 362/61

4,947,294 8/1990 Van Duyn et al. ..... 362/61

FOREIGN PATENT DOCUMENTS 2528535 12/1983 France .

2638406 5/1990 France .

*Primary Examiner*—Cassandra Spyrou

*Assistant Examiner*—Jared Treas

*Attorney, Agent, or Firm*—Weingarten, Schurgin, Gagnebin & Hayes LLP

[57] ABSTRACT

A head lamp device has a connector guide which enables a feeder connector to be insertable into a bulb, only rotating the bulb to a fixed position specified. In this manner, a feeder connector is not insertable in a socket when the bulb is not in the fixed position so that even inexperienced operators can surely enforce the replacement of the bulb, therefore, a specified light distribution can be surely obtained.

2 Claims, 3 Drawing Sheets

HEAD LAMP DEVICE

BACKGROUND OF THE INVENTION

1. Field of the Invention

The present invention relates to a head lamp device mounted on a vehicle, and particularly to a head lamp device which can be fixed with a bulb by using a bayonet mechanism in its installation.

2. Background Art

FIGS. 3 and 4 illustrate a construction of this type of a conventional head lamp device 90 employing, for example, a bulb 10 having three bayonet pawls 11. The head lamp device 90 has a bayonet holder 92 which consists of a base 92*a*, a cover 92*b* and other parts, has a shape to be engaged with the bayonet pawls 11 of the bulb 10, and provided at suitable position of such as a reflector 91 back face.

When the bulb 10 is installed in the head lamp device 90, the bulb 10 is inserted into the bayonet holder 92 at an inserted position IN wherein the bayonet pawls 11 thereof can be directly inserted. Subsequently, the bulb 10 is rotated clockwise to a fixed position FX, so that the bayonet pawls 11 can be fixed and held between the base 92*a* and the cover 92*b*.

After the bulb 10 has been fixed with the head lamp device 90 as described above, a feeder connector 20 provided on the vehicle body side is fixed with a socket 12 of the bulb 10 to connect the bulb 10 to a power supply of the vehicle and the bulb 10 can be turned on/off on demand.

Moreover, for the removal of the bulb 10, the bulb 10 rotates counterclockwise from the fixed position FX to the inserted position IN and then become removable because the bayonet pawls are released from the cover 92*b*. The bulb 10 is detachable in this simple way, so that an operator or a driver can easily replace a broken bulb with new one.

However, in the conventional head lamp device 90 as described above, the bulb 10 may be insufficiently rotated from the inserted position IN to the fixed position FX over the range of about 30° to 40° in the installation because inexperienced users for the replacement mostly operate the bulb.

For obtaining a specific light distribution in a head lamp bulb 10 having a main beam filament and a low beam filament, the fixed position FX of the bulb 10 in the head lamp device should be exactly specified so that the relationship between the bulb and the fixed position is appropriate.

For insufficient rotation as describe above, the specified light distribution may not be obtained. When the vehicle travels in the above status, it causes problems such as, for example dazzling to oncoming cars. For the insufficient rotation status of the bulb, another problem occurs such as, for coming off the bulb by a vibration of a driven vehicle as a result of an insufficient holding force to the bulb 10 within the bayonet holder 92. Therefore, such a head lamp device is desired to improve these problems.

SUMMARY OF THE INVENTION

To overcome the above conventional problems, an object of the present invention is to provide a head lamp device with a bayonet holder, wherein a bulb provided with bayonet pawls is inserted in said bayonet holder at a inserted position and is fixed with said bayonet holder by rotating to a fixed position, and only in rotating said bulb completely to said fixed position, a feeder connector is insertable in said bulb by means of a connector guide.

Another object of the present invention is to provide a head lamp device, wherein a barrier is provided in rotation range from said bulb inserted position of said connector guide to said fixed position in which a feeder connector is insertable in the head lamp device described above.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The present invention is described in detail hereinafter with reference to embodiments shown in the accompanying drawings.

Figure 1:
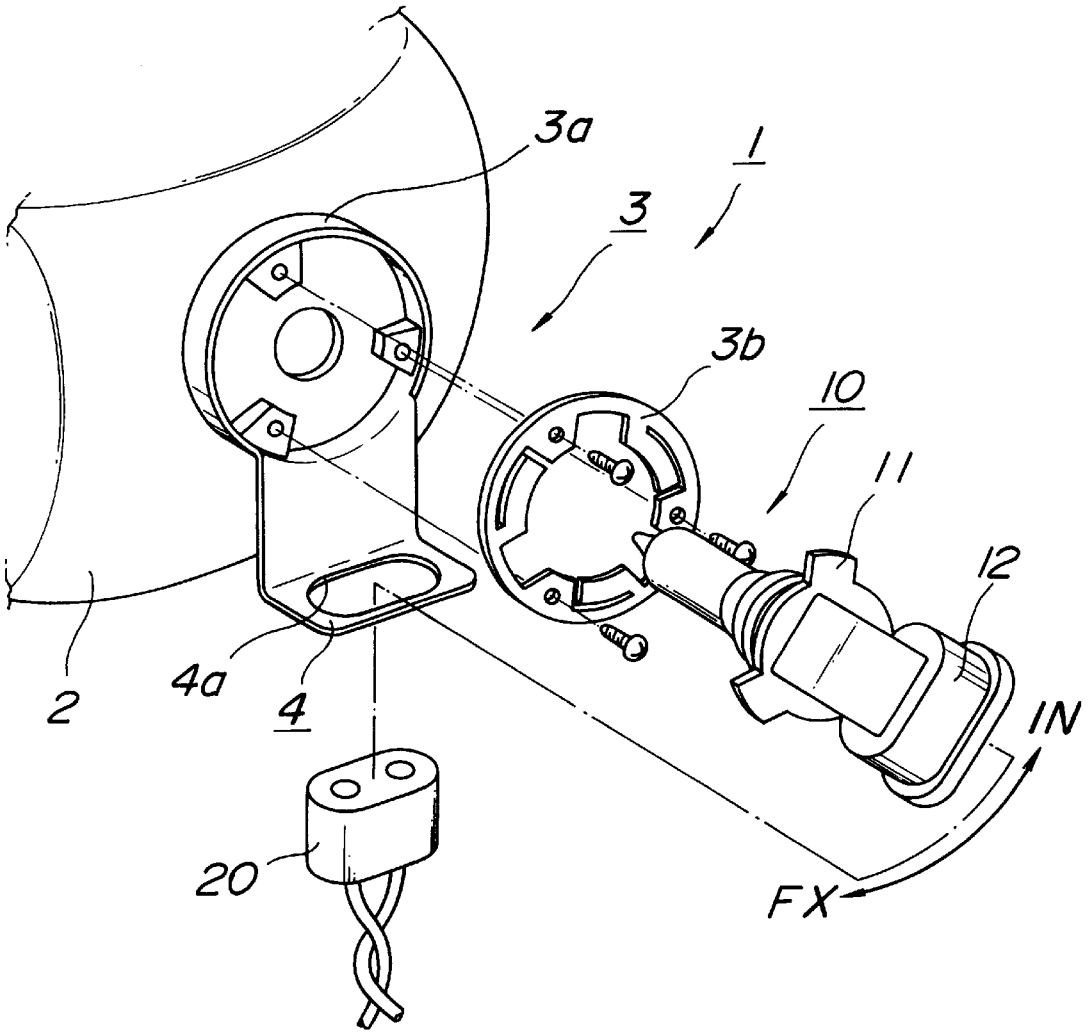
FIG. 1 is a fragmentary exploded perspective view of an embodiment of the head lamp device in accordance with the present invention.

In FIG. 1 reference numeral 1 denotes a head lamp device in accordance with the present invention. A reflector 2 of this head lamp device 1 has a bayonet holder 3 which consists of a base 3*a*, a cover 3*b* and other parts on the back face thereof and a bayonet pawl 11 formed in a bulb 10 is fixed with the bayonet holder 3 similarly in the conventional method.

Moreover, the bayonet holder 3 has an inserted position IN in which the bayonet pawl 11 of the bulb 10 is insertable and a fixed position FX which is specified position to be obtained in a proper light distribution of the bulb 10 for the reflector 2. In installing the bulb 10, the bulb 10 is rotated from the inserted position IN to the fixed position FX similarly in the conventional device.

The present invention is further provided with a connector guide 4 on an appropriate position of the bayonet holder 3 or reflector 2 back face. In the present embodiment, the connector guide 4 is formed in a base 3*a* of the bayonet holder 3. This connector guide 4 specifies an inserted position for a feeder connector 20 to be connected to a socket 12 of the bulb 10.

In more detail, the position provided with the connector guide 4 corresponds to the fixed position FX on the bayonet holder 3. In addition, the connector guide 4 is provided with a hole 4*a* which has the same shape of an outward form of the feeder connector 20. In installing the feeder connector 20 in the socket 12, the feeder connector 20 must pass through the hole 4*a*.

In other wards, when the bulb 10 insufficiently rotates to the fixed position FX, the socket 12 can not reach the position corresponding to the hole 4*a* of the connector guide 4, and thus, the feeder connector 20 specified by the hole 4*a* of the connector guide 4 is not insertable in the socket 12.

Therefore, in accordance with the present invention, the feeder connector 20 is not insertable as long as the bulb 10 incompletely rotates to the fixed position FX. Accordingly, the operators inexperienced in the replacement of the bulb may also notice that the feeder connector 20 is not insertable into the socket 12 if the bulb 10 is insufficiently rotated to the fixed position FX.

Moreover, the feeder connector 20 to be insertable, in other wards, the head lamp device 1 to be turned on, secure the installation of the bulb 10 fixed to the specified position for the reflector 2. Therefore, even though the operators have no knowledge of the relationship between the head lamp device 1 and the bulb 10 on the specific light distribution, they can surely replace the bulb with new one without damage of the light distribution.

In practice, the shape of the connector guide 4 is not restricted, may be such as two rods spaced by the corresponding width of the feeder connector 20, or substantially U-shaped in contact with three sides of the feeder connector 20. Namely, it can be any shape as long as the feeder connector 20 is not insertable in the socket 12 except when rotating the bulb 10 to the fixed position FX.

Similarly, the position of the connector guide 4 to be provided is not restricted if the above requirement is satisfied. The connector guide 4 may be provided in the base 3*a* or cover 3*b* of the bayonet holder 3, or reflector 2 as shown in this embodiment.

Figure 2:
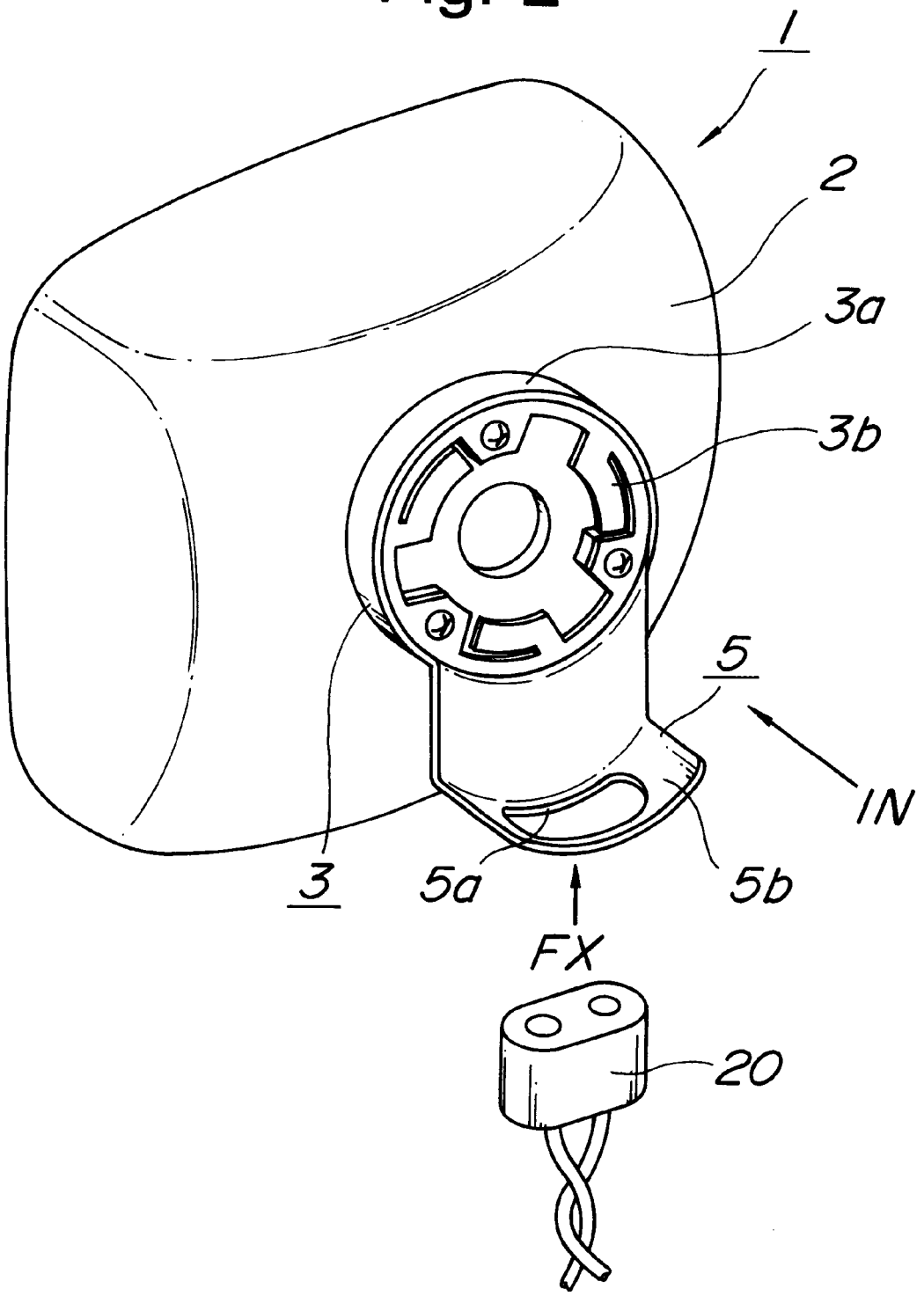
FIG. 2 is a perspective view showing a main part of another embodiment of the head lamp device in accordance with the present invention.
Figure 3:
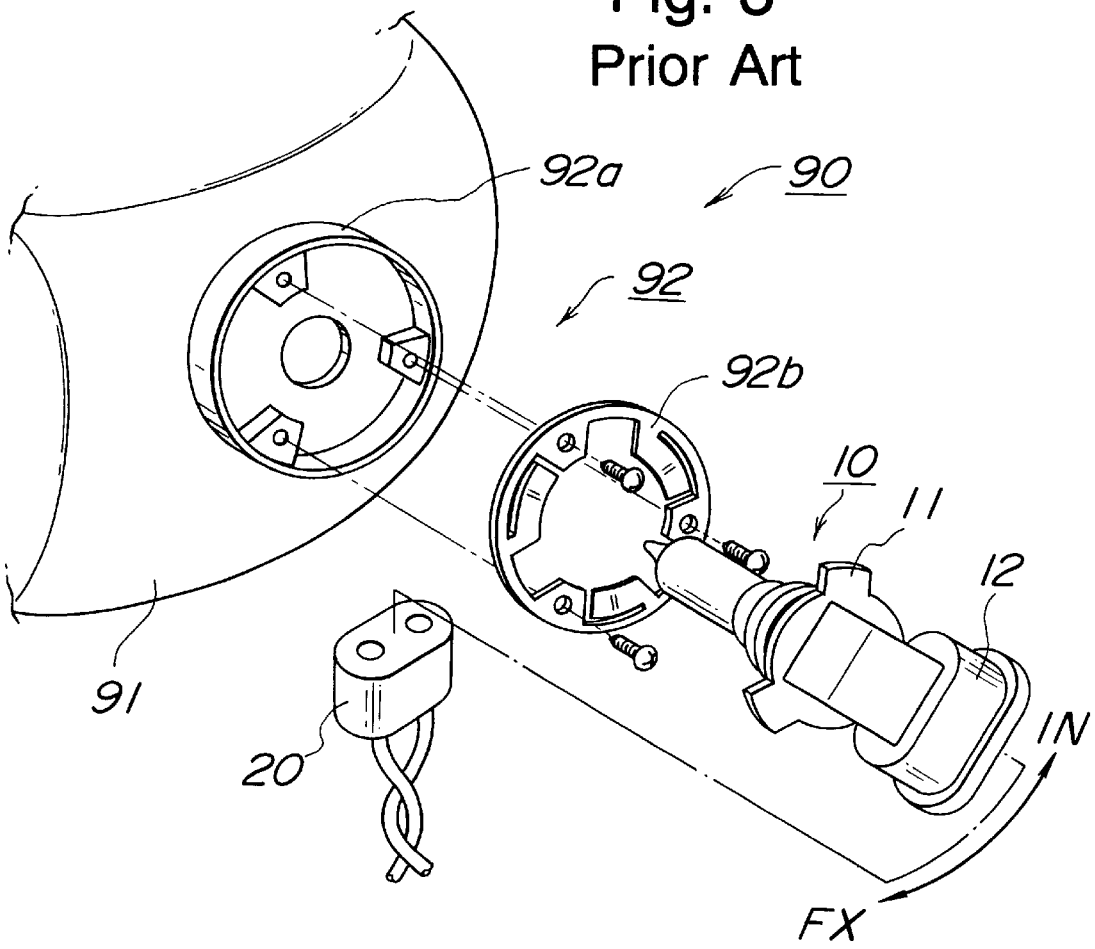
Fig. 3 Prior Art
FIG. 3 is a fragmentary exploded perspective view of a conventional head lamp device.
Figure 4:
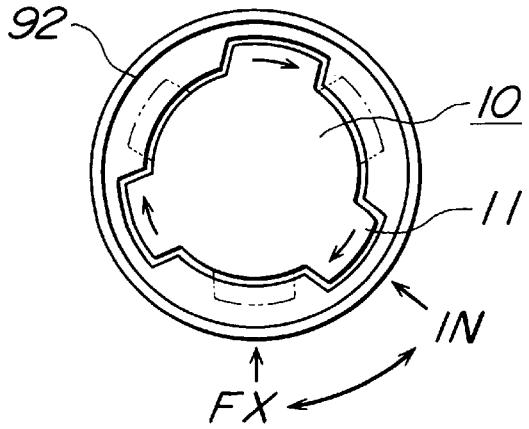
Fig. 4 Prior Art
FIG. 4 is a front elevation showing a main part of the conventional head lamp.

FIG. 2 shows another embodiment of the present invention. In a connector guide 5 of this embodiment, the feeder connector 20 is positioned by using a hole 5*a* formed therewithin and is not insertable by providing with a barrier 5*b* in the range of rotation from the inserted position IN to the fixed position FX of the bulb 10, while in the first embodiment the connector guide 4 is positioned for the fixed position FX of the feeder connector 20. In this embodiment, the barrier 5*b* is formed as the end of the connector guide 5 which has curvature having a radius corresponding to the distance from the center of optical axis to the end of socket 12.

In this manner, to begin with, the bulb is not insertable because barrier 5*b* interferes with the feeder connector 20, even though the bulb 10 having been connected with the feeder connector 20 is intended to insert in the bayonet holder 3.

Therefore, the feeder connector 20 must be disconnected from the bulb 10 in installing the bulb 10. Only when the bulb 10 is rotated completely to the fixed position, the feeder connector 20 is connectable with the bulb 10 via the hole 5*a*, so that the operator can surely enforce the manner according to the present invention.

In accordance with the present invention as described above, the feeder connector is not insertable in the socket when the bulb is not in the fixed position so that even the inexperienced operator can surely enforce the replacement of the bulb. In this manner, the present invention prevents the vehicle running with an unsuitable light distribution, thus it is very effective for further traffic safety.

While the presently preferred embodiment of the present invention have been shown and described, it will be understood that the present invention is not limited thereto, and that various changes and modifications may be made by those skilled in the art without departing from the scope of the invention as set forth in the appended claims.

What is claimed is:

1. A head lamp device with a bayonet holder, in which a bulb provided with bayonet pawls is inserted in said bayonet holder at a inserted position and is fixed with said bayonet holder by rotating to a fixed position, characterized in that said head lamp device further comprises a connector guide which enables a feeder connector to be insertable in said bulb only in rotating said bulb completely to said fixed position.

2. The head lamp device of claim 1, wherein a barrier is further provided with said connector guide in a rotation range of the bulb from a bulb inserted position to said fixed position at which said feeder connector is insertable.

* * * * *

UNITED STATES PATENT AND TRADEMARK OFFICE

CERTIFICATE OF CORRECTION

PATENT NO. : 6,082,883
DATED : July 4, 2000
INVENTOR(S) : Yoichi Tatsumi, et al.

It is certified that error appears in the above-identified patent and that said Letters Patent is hereby corrected as shown below:

Column 4,
Line 27, "in rotating said bulb completely to" should read -- when said bulb is completely rotated to --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*